US010604221B2

(12) United States Patent
Bonel et al.

(10) Patent No.: US 10,604,221 B2
(45) Date of Patent: Mar. 31, 2020

(54) UNMANNED UNDERWATER VEHICLE, SYSTEM AND METHOD FOR THE MAINTENANCE AND INSPECTION OF UNDERWATER FACILITIES

(71) Applicant: SAIPEM S.p.A., San Donato Milanese (IT)

(72) Inventors: Paolo Bonel, Venice (IT); Giovanni Massari, Venice (IT); Diego Lazzarin, Treviso (IT)

(73) Assignee: SAIPEM S.p.A., San Donato Milanese (IT)

( * ) Notice: Subject to any disclaimer, the term of this patent is extended or adjusted under 35 U.S.C. 154(b) by 0 days.

(21) Appl. No.: 16/082,439

(22) PCT Filed: Mar. 10, 2017

(86) PCT No.: PCT/IB2017/051423

§ 371 (c)(1),
(2) Date: Sep. 5, 2018

(87) PCT Pub. No.: WO2017/153966

PCT Pub. Date: Sep. 14, 2017

(65) Prior Publication Data

US 2019/0084658 A1 Mar. 21, 2019

(30) Foreign Application Priority Data

Mar. 11, 2016 (IT) ..... 102016000025989

(51) Int. Cl.
*B63G 8/00* (2006.01)
*B63C 11/52* (2006.01)

(52) U.S. Cl.
CPC ..... *B63G 8/001* (2013.01); *B63C 11/52* (2013.01); *B63G 2008/005* (2013.01); *B63G 2008/007* (2013.01); *B63G 2008/008* (2013.01)

(58) Field of Classification Search
CPC . B63G 8/00; B63G 8/001; B63G 8/08; B63G 8/16; B63H 11/107; B63C 11/00;
(Continued)

(56) References Cited

U.S. PATENT DOCUMENTS 6,390,012 B1 5/2002 Watt et al.
6,928,947 B1 * 8/2005 Clapham ..... B63C 11/42 114/312

(Continued)

FOREIGN PATENT DOCUMENTS

GB 2 521 626 7/2015
WO WO 2015/061600 4/2015
WO WO 2015/124938 8/2015

OTHER PUBLICATIONS

Notification Concerning Submission, Obtention or Transmittal of Priority Document for International Application No. PCT/IB2017/051423 dated Jul. 3, 2017.

(Continued)

*Primary Examiner* — Lars A Olson
(74) *Attorney, Agent, or Firm* — Neal, Gerber & Eisenberg LLP

(57) ABSTRACT

An unmanned underwater vehicle of a system for the maintenance and inspection of permanent underwater facilities having a first interface configured for structurally and functionally coupling to an operational module selected on the basis of specific needs from a plurality of interchangeable operational modules featuring different characteristics, and a second interface configured for structurally and functionally coupling to a power and communication module selected on the basis of specific needs from a plurality of interchangeable power and communication modules featuring different characteristics.

24 Claims, 3 Drawing Sheets

(58) Field of Classification Search
CPC ..... B63C 11/52; B25J 9/00; B25J 9/08; B63B 3/00; B63B 3/13; A63B 9/00; A63B 9/06
USPC ..... 114/312, 313, 337
See application file for complete search history.

(56) References Cited

U.S. PATENT DOCUMENTS

| | | | | |
|---|---|---|---|---|
| 8,082,870 | B2 * | 12/2011 | Shen | B63G 8/001 114/337 |
| 8,695,525 | B2 * | 4/2014 | Lee | B63G 8/08 114/312 |
| 2002/0040783 | A1 | 4/2002 | Zimmerman et al. | |
| 2009/0211511 | A1 | 8/2009 | Shen | |
| 2014/0107862 | A1 | 4/2014 | Jung | |

OTHER PUBLICATIONS

International Search Report and Written Opinion for International Application No. PCT/IB2017/051423 dated Jun. 30, 2017.
Offshore Technology Conference 24307 presentation "Steps to Subsea Factory" by O. Oekland et al, Oct. 29, 2013 (10 pages).

* cited by examiner

UNMANNED UNDERWATER VEHICLE, SYSTEM AND METHOD FOR THE MAINTENANCE AND INSPECTION OF UNDERWATER FACILITIES

PRIORITY CLAIM

This application is a national stage application of PCT/IB2017/051423, filed on Mar. 10, 2017, which claims the benefit of and priority to Italian Patent Application No. 102016000025989, filed on Mar. 11, 2016, the entire contents of which are each incorporated by reference herein.

TECHNICAL FIELD

The present disclosure relates to an unmanned underwater vehicle for the maintenance and inspection of permanent underwater facilities.

BACKGROUND

In particular, in the oil & gas industry, it is known to create permanent underwater facilities for the extraction and/or production of hydrocarbons from wells drilled in the bed of a body of water. Within the scope of this description, the term "permanent" means underwater facilities intended to operate on the bed of a body water for an indefinite number of years. In the description that follows, the term "hydrocarbon production" means the extraction of hydrocarbons, the processing of hydrocarbons, the treatment of fluids related to hydrocarbon production and the subsequent transport.

Underwater hydrocarbon production facilities can be placed at or relatively close to subsea wells or in intermediate locations, and can have various configurations on the bed of a body water depending on the well or well field. In addition, underwater hydrocarbon production facilities can be positioned in relatively shallow water or in relatively very deep water and in any geographic area, independently of whether environmental conditions are mild or extreme.

The concept of an underwater hydrocarbon production facility was developed by operators in the industry with the objective of rationalizing hydrocarbon production from subsea wells. In short, an underwater hydrocarbon production facility is part of a complex installation that comprises an underwater hydrocarbon production facility and pipelines for relatively long-distance transportation between underwater facilities and surface structures. The exploitation of subsea oil and/or gas fields via underwater hydrocarbon production facilities that provide for the extraction and transport of the hydrocarbon to the surface or coast has been under way for some time and expansion in the near future is foreseeable. Recent technological developments in underwater devices suitable for working at relatively great depths and the great interest of oil companies have facilitated the feasibility of relatively complex systems, broadened the potentiality of underwater production facilities and made any type of active process in water possible. The main underwater treatment processes are: fluid pumping or compression, multiphase pumping, liquid/liquid separation, gas/liquid separation, solid/liquid separation, oil/water/gas separation, treatment and pumping, water treatment, heat exchange, and injection of water or gas into the well.

Further information on the current state of underwater hydrocarbon production facilities are available in the document OTC 24307 "STEPS TO THE SUBSEA FACTORY" by Rune Ramberg (Statoil), Simon RH Davies (Statoil), Hege Rognoe (Statoil), and Ole Oekland (Statoil).

There is no doubt that underwater hydrocarbon production facilities provide numerous advantages, but the construction, maintenance and control of an underwater hydrocarbon production facility are beset by problems that grow as the depth and/or environmental constraints increase.

In particular, the maintenance and inspection of underwater facilities is currently carried out by unmanned underwater vehicles, which comprise two distinct types of vehicle: ROVs (Remoted Operated Vehicle), each of which is connected to a base station by an umbilical cable, through which ROV receives power and exchanges signals, and AUVs (Automated Underwater Vehicle), each of which has an autonomous power source and is configured to operate on the basis of predefined programs and to upload any information collected in the operational phase once AUV returns to the base station. U.S. Published Patent Application No. 2002/0040783, PCT Patent Application No. WO 2015/061600, U.S. Pat. No. 6,390,012 and PCT Patent Application No. WO 2015/124938 illustrate underwater vehicles and/or maintenance and inspection systems for underwater facilities that employ underwater vehicles of the above-indicated type. Known systems generally use only one type underwater vehicle, with the consequent operating limits, or different types of underwater vehicles, but to the detriment of operating costs. The above-mentioned solutions are completely or partially ineffective, especially where the environmental conditions or the facility's configuration make the support they need from surface vessels economically or technically impracticable.

SUMMARY

The object of the present disclosure is to provide an underwater vehicle capable of overcoming certain of the drawbacks of certain of the known art.

In accordance with the present disclosure an unmanned underwater vehicle is provided for the maintenance and inspection of permanent underwater facilities, the underwater vehicle comprising a first interface configured for structurally and functionally coupling to an operational module selected on the basis of specific needs from a plurality of interchangeable operational modules featuring different characteristics, and a second interface configured for structurally and functionally coupling to a power and communication module selected on the basis of specific needs from a plurality of interchangeable power and communication modules featuring different characteristics.

The first and the second interfaces are configured to enable the independent coupling in the body of water between the underwater vehicle and the plurality of operational modules and plurality of power and communication modules.

It should thus be appreciated that the unmanned underwater vehicle disclosed herein can be configured based on the specific needs defined by the operation that the unmanned underwater vehicle is required to perform on the underwater facility.

In particular, the first and the second interface are functionally interconnected so as to mutually transfer power and signals. In this way, the underwater vehicle acts as an intermediary between the power and communication modules and the operational modules.

In particular, the underwater vehicle comprises a frame, at least one buoy, with variable trim if necessary, and a plurality of thrusters. In other words, the underwater vehicle is equipped with all the navigation aids that enable underwater vehicle to navigate in the body of water.

In particular, the underwater vehicle comprises at least one power accumulator and a control unit. In practice, the underwater vehicle has an autonomy, albeit reduced, which enables the underwater vehicle to move around the underwater facility.

In particular, the underwater vehicle comprises navigation sensors, in particular a gyrocompass, a speed sensor, accelerometers, acoustic positioning systems, and obstacle avoidance systems (for example, acoustic or electromagnetic ones). In this way, the underwater vehicle is able to move and orient itself in tight spaces as required for maintenance and inspection operations.

A further object of the present disclosure is to provide a system for the maintenance and inspection of underwater facilities that does not have certain of the drawbacks of certain of the known art.

In accordance with the present disclosure, a system is provided for the maintenance and inspection of underwater facilities, the system comprising at least one underwater vehicle of the above-indicated type, a plurality of interchangeable operational modules featuring different characteristics, and a plurality of interchangeable power and communication modules featuring different characteristics. In this way, the system offers a plurality of configurations for the underwater vehicle. The number of possible configurations is given by the number of different operational modules multiplied by the number of different power and communication modules. By connecting a pair of modules, the underwater vehicle is able to dynamically and automatically adapt itself each time the system is reconfigured.

In particular, the plurality of operational modules comprises at least one manipulator operational module, at least one tool operational module, and at least one inspection operational module. It should be appreciated that this number of three different operational modules is not intended to indicate a limit, but is simply an example.

In greater detail, the manipulator operational module comprises a manipulator arm, such as electric, and a third interface configured for structurally and functionally coupling to the first interface of the underwater vehicle. In this way, the manipulator operational module is able to deftly perform relatively precise manipulations.

The tool operational module comprises a tool, a respective actuator, and a fourth interface configured for structurally and functionally coupling to the first interface of the underwater vehicle, and is used in operations where relatively considerable force is required.

The inspection operational module comprises a probe, which, for example, comprises a camera, an acoustic sensor and an electromagnetic sensor, and a fifth interface configured for structurally and functionally coupling to the first interface of the underwater vehicle. In this way, it is possible to detect functional or structural anomalies in the underwater facility.

The plurality of power and communication modules comprises a cable power and cable communication module, a battery power and wireless communication module, and a battery power and cable communication module. Also in this case, the three different types of power and communication module is not intended to be a limit on the number of types of power and communication modules.

In greater detail, the cable power and cable communication module comprises a power supply block, a cable for power and data transmission, and a sixth interface configured for structurally and functionally coupling to the second interface of the underwater vehicle. This module ensures limitless autonomy and a high real-time data transmission capability.

The battery power and wireless communication module comprises a battery block, a transceiver, and a seventh interface configured for structurally and functionally coupling to the second interface of the underwater vehicle. In this case, the absence of the cable ensures greater maneuverability for the underwater vehicle against more limited autonomy and a restricted real-time data transmission capability.

The battery power and cable communication module comprises a battery block, a data cable, and an eighth interface configured for structurally and functionally coupling to the second interface of underwater vehicle. In this case, the data cable ensures moderate maneuverability without any limitation on the real-time data transmission capability.

In accordance with one embodiment, each operational module is configured to be powered independently of the underwater vehicle. If necessary, power can also be received from the underwater facility on which operations are being performed via a further interface configured to implement a coupling with the underwater facility, for example via cable.

In general, each operational module is powered by one of the power and communication modules through the underwater vehicle, which transfers part of the power from the power and communication module to the operational module and, in part, uses the power of the power and communication module for its own functions.

The system comprises at least one base station configured for housing the underwater vehicle, the operational modules, and the power and communication modules. The base station offers shelter for the underwater vehicle and the various modules when they are not used in maintenance and inspection operations.

The base station has parking stations for power recharging and is connected to the outside, for example to the surface or to other underwater systems, by an umbilical cable.

In certain embodiments, the parking stations can even be located in different positions along the underwater facility.

Furthermore, base station comprises cable and wireless communication systems for communicating with the underwater vehicle.

If the size and/or configuration of the underwater facility is too large, it may become necessary to provide one or more communication stations configured to repeat the wireless signals of the base station, which can also serve as navigation references.

The base station comprises a cleaning device configured to clean the underwater vehicle, the plurality of operational modules, and the plurality of power and communication modules. The long permanence of these vehicles in the body of water favours the formation of surface deposits and fouling, which must be cyclically removed. To this end, the cleaning device is configured to carry out mechanical and non-mechanical cleaning. Mechanical cleaning includes pressurized water jets and brushes for removing surface deposits and fouling. Non-mechanical cleaning comprises UV lamps and chemical products (for example, biocides).

The system is particularly suited to being used for the maintenance and inspection of underwater facilities used for hydrocarbon production. The system is particularly suited to carrying out operations in a relatively very complex scenario such as that of an underwater hydrocarbon production facility. Accordingly, the system is configured for long immersions and minimal dependence on surface vessels, being relatively highly versatile and, at the same time, relatively inexpensive to operate.

Another object of the present disclosure is to provide a method for the maintenance and inspection of underwater facilities that does not have certain of the drawbacks of certain of the known art.

In accordance with the present disclosure, a method is provided for the maintenance and inspection of permanent underwater facilities, the method comprising the steps of structurally and functionally coupling a first interface of the underwater vehicle to an operational module selected on the basis of specific needs from of a plurality of interchangeable operational modules featuring different characteristics, and structurally and functionally coupling a second interface of the vehicle to a power and communication module selected on the basis of specific needs from a plurality of interchangeable power and communication modules featuring different characteristics.

Additional features and advantages are described in, and will be apparent from the following Detailed Description and the figures.

BRIEF DESCRIPTION OF THE DRAWINGS

Further characteristics and advantages of the present disclosure will become clear from the description that follows of certain embodiments, with reference to the figures in the accompanying drawings, in which.

DETAILED DESCRIPTION

Figure 1:
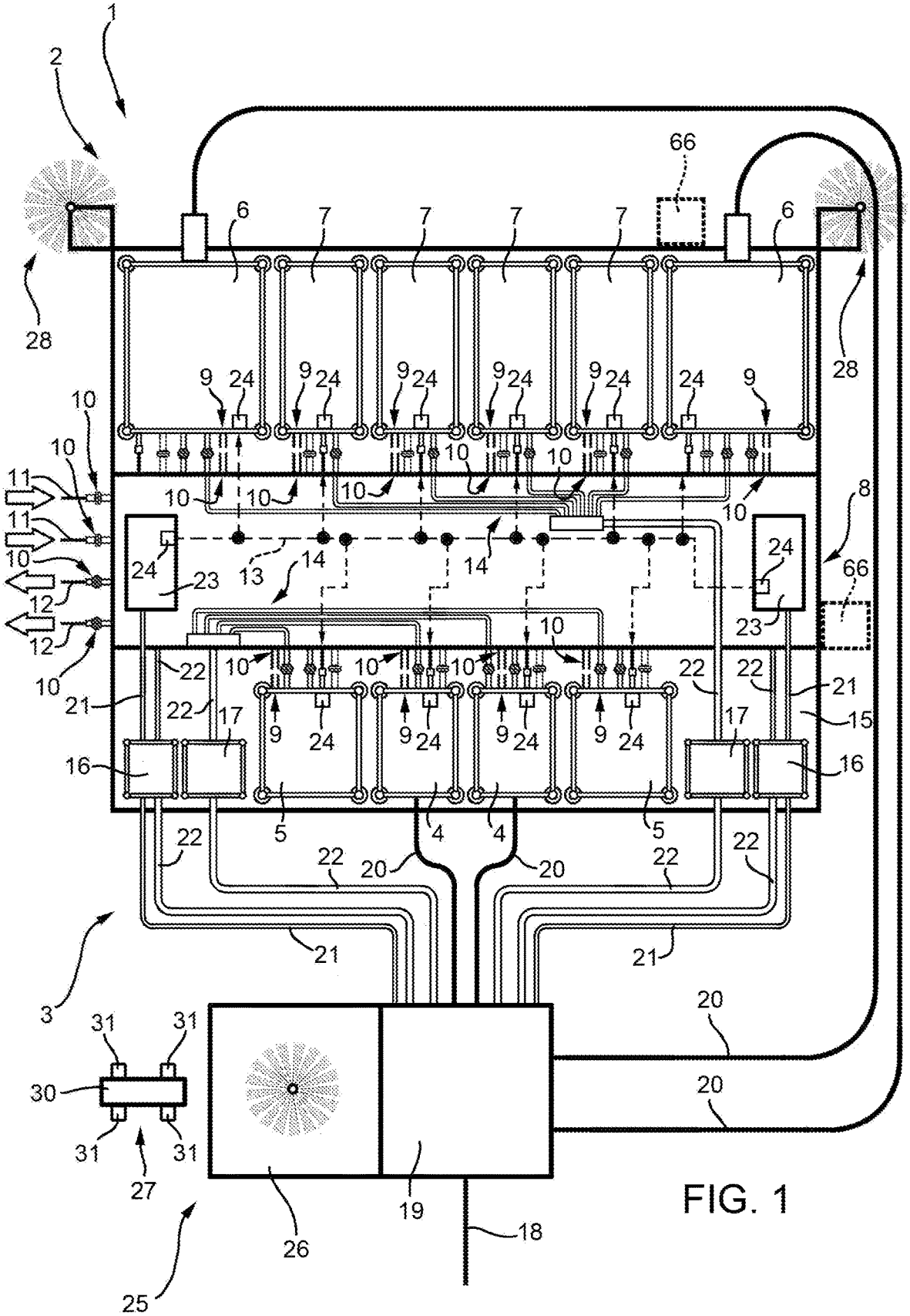
FIG. 1 is a schematic plan view, with parts removed for clarity, of an underwater hydrocarbon production facility and a maintenance and inspection system made in accordance with the present disclosure and integrated with the underwater facility.

Referring now to the example embodiments of the present disclosure illustrated in FIGS. 1 to 12, as seen in FIG. 1, reference numeral indicates an underwater hydrocarbon production facility. The facility 1 is arranged on a bed 2 of a body of water near a subsea well or well field (not shown in the accompanying figures), and comprises a cluster 3, which comprises a plurality of functional modules 4, 5, 6 and 7 configured to process hydrocarbons, and an interconnection unit 8 configured for being arranged on the bed 2 of the body of water to connect the functional modules 4, 5, 6 and 7 to each other. Each of the functional modules 4, 5, 6 and 7 comprises a plurality of connection elements 9, while the interconnection unit 8 comprises a plurality of connection elements 10, each configured for being operatively connected to a corresponding connection element 9 of one of the functional modules 4, 5, 6 and 7.

In greater detail, each of the functional modules 4, 5, 6 and 7 houses a respective apparatus configured to process hydrocarbons or perform operations related to hydrocarbon processing. In this description, the term apparatus is used to indicate: multiphase pump (function: multiphase pumping), liquid pump, gas compression, liquid/liquid separator, gas/liquid separator, solid/water separator, heat exchanger, water injection pump, chemical injection system, gas treatment system, oil treatment system, and water treatment system.

The interconnection unit 8 comprises further connection elements 10 configured to connect the inlet pipelines 11 and another two connection elements 10 configured to connect to two respective outlet pipelines 12 that run to respective headers (not shown in the accompanying figures).

The connection elements 10 are interconnected by tubes (which are not shown in FIG. 1) and are housed in the interconnection unit 8, configured to transfer process fluids between the functional modules 4, 5, 6 and 7, the inlet pipelines 11 and the outlet pipelines 12, according to a certain layout. The interconnection unit 8 also comprises valves (which are not shown in FIG. 1) which are housed inside the interconnection unit 8, configured to regulate the flow of the process fluids.

The interconnection unit 8 is configured to collect and distribute signals, electric power, chemical products and hydraulic fluids to and from the functional modules 4, 5, 6 and 7. In consequence, the interconnection unit 8 comprises a control bus 13 and a plurality of tubes 14 configured to convey chemical products and/or hydraulic fluids.

The facility comprises a platform 15 on which the interconnection unit 8, the functional modules 4, 5, 6 and 7, two junction boxes 16, and two distribution units 17 rest. Signals, chemical products, hydraulic fluids and electric power are conveyed through an umbilical cable 18 and a switching unit 19, which distributes electric power directly through power cables 20 to modules 4 and 6, which house pumps or compressors. The switching unit 19 is connected to the two junction boxes 16 via a control bus 21 and a tube bundle 22 for hydraulic fluids, and to the chemical product distribution units 17 by a tube bundle 22. The junction boxes 16 and the chemical product distribution units 17 are in turn connected to the interconnection unit 8.

The interconnection unit 8 shown in FIG. 1 comprises two junction boxes 23, and two underwater control devices 24 that, in the case shown, are associated with the respective junction boxes 23 and are configured to process signals acquired from the functional modules 4, 5, 6 and 7, to emit control signals configured to control the functional modules 4, 5, 6 and 7, and to open and close the valves (not shown in the accompanying figures).

Each of the functional modules 4, 5, 6 and 7 comprises an underwater control device 24 configured to control the parameters related to the associated process. In particular, each of the underwater control devices 24 of the interconnection unit 8 has the master function and is connected to all of the underwater control devices 24, which are installed in the functional modules 4, 5, 6 and 7 and have the slave function.

The entire supervision of the facility 1 is carried out from a surface control station equipped with monitors (not shown in the accompanying figures). In the case shown, the control system of the underwater facility 1 has a distributed-node architecture and comprises a distributed-node network comprising the control buses 13 and 21, and the junction boxes 16 and 23. The network connects the functional modules 4, 5, 6 and 7, or rather the underwater control devices 24 associated with the respective functional modules 4, 5, 6 and 7, and the switching unit 19 that, in turn, is connected to a surface control unit (not shown in the accompanying figures). Each underwater control device 24 is placed at a respective node of the network to isolate the respective functional module 4 or 5 or 6 or 7 from the control network.

In the case shown, the underwater control devices 24 arranged in respective junction boxes 23, both have the master function and perform exactly the same functions, while the network connects the master control devices 24 to the switching unit 19 independently of one another. In consequence, the control system is redundant.

In accordance with a variant that is not shown, the master control devices 24 are placed at other points of the control network, but conveniently inside the interconnection module 8.

The underwater facility 1 is integrated by a maintenance and inspection system 25, which, in the case shown, comprises a base station 26, an unmanned underwater vehicle 27, and two communication stations 28, the need for which or the number of which is based on the size and the configuration of the facility 1. The base station 26 is adjacent to the switching unit 19 and is connected to the umbilical cable 18 from which the base station receives power and through which the base station exchanges signals with a surface station (not shown in the accompanying figures).

The base station 26 has the function of housing the underwater vehicle 27 and of performing service operations on the underwater vehicle 27. In the embodiment shown, the communication stations 28 are placed in the areas furthest away from the base station 26.

Figure 2:
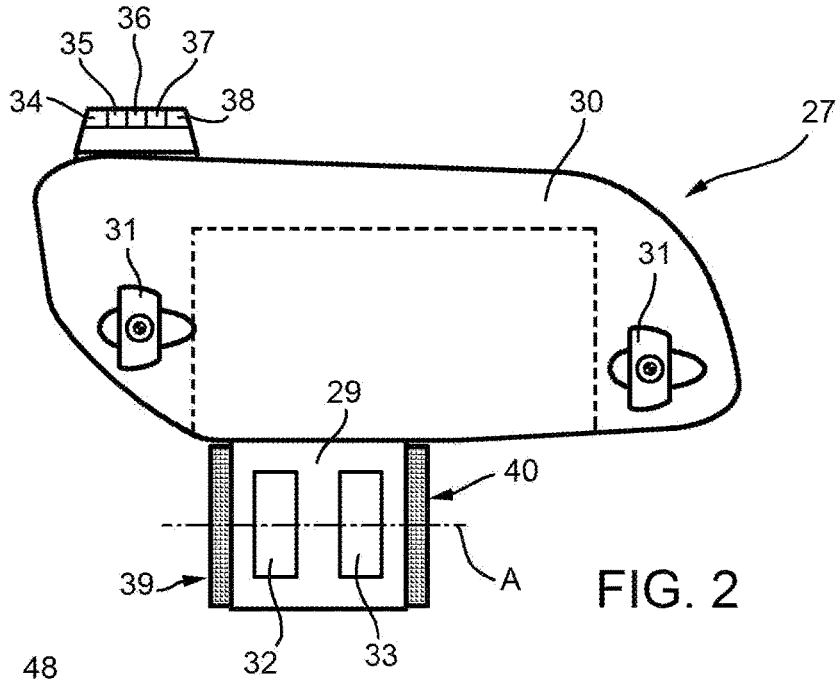
FIG. 2 is a side elevation view, with parts removed for clarity, of an unmanned underwater vehicle made in accordance with the present disclosure and part of the maintenance and inspection system in FIG. 1.

Referring to FIG. 2, the unmanned underwater vehicle 27 has a longitudinal axis A and comprises a frame 29, at least one buoy 30, with variable trim if necessary, and a plurality of thrusters 31, which together define the navigation devices of the underwater vehicle 27. The underwater vehicle 27 comprises at least one power accumulator 32, and a control unit 33 so as to define control and minimum autonomy for the underwater vehicle 27.

The underwater vehicle 27 comprises navigation sensors, which include a gyrocompass 34, a speed sensor 35, accelerometers 36, acoustic positioning systems 37, and an obstacle avoidance system 38 of the acoustic or electromagnetic type, which enable navigating by instrument in relatively complex scenarios.

In various embodiments, the buoy 30 defines the upper part of the underwater vehicle 27, while the frame 29 in the lower part of the underwater vehicle 27 supports two interfaces 39 and 40. In certain embodiments described herein, the two interfaces 39 and 40 are perpendicular to the longitudinal axis A of the underwater vehicle 27 and define two opposite faces of the lower part of the underwater vehicle 27.

The system 25 in FIG. 1 also comprises a plurality of operational modules 41, 42 and 43 (FIGS. 3, 4 and 5, respectively), each of which is configured to be coupled to the underwater vehicle 27 on interface 39, and a plurality of power and communication modules 44, 45 and 46 (FIGS. 6, 7 and 8 respectively), each of which is configured to be coupled to the underwater vehicle 27 on interface 40. The operational modules 41, 42 and 43 comprise a manipulator module 41 (FIG. 3), at least one tool module 42 (FIG. 4), and at least one inspection module (FIG. 5).

Figure 3:
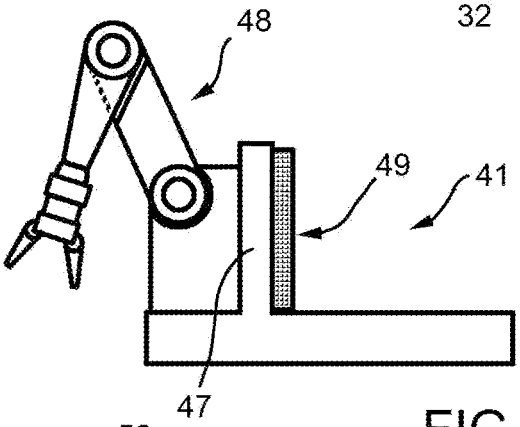
FIGS. 3 to 5 are side elevation views, with parts removed for clarity, of respective operational modules made in accordance with the present disclosure and parts of the maintenance and inspection system in FIG. 1.

Referring to FIG. 3, the manipulator module 41 comprises a support structure 47, a manipulator arm 48, especially of the electric type and mounted on the support structure 47, and an interface 49 that defines a face of the support structure 47 and is configured for being connected to interface 39. The manipulator module 41 has the task of performing operations that require the manipulation of objects with a relatively high level of precision and relatively small forces.

Figure 4:
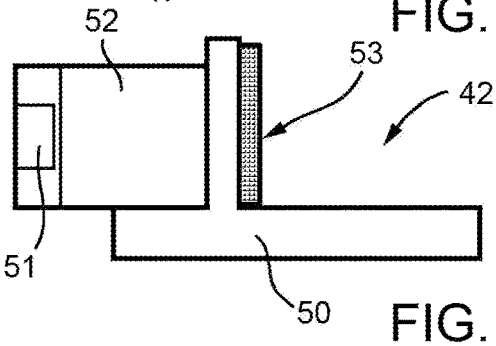

Referring to FIG. 4, the tool module 42 comprises a support structure 50, a tool 51 mounted on the support structure 50, a power actuator 52 mounted on the support structure 50 to operate the tool 51, and an interface 53 that defines a face of the support structure 50 and is configured for being connected to interface 39 of the underwater vehicle 27. The tool module 42 has the task of performing operations that require the use of relatively high force or supplying fluid at relatively high pressure (for example, to carry out sealing tests or water injections from a nozzle). In consequence, the term "tool" identifies both the actual tool, for example a screwdriver, and an apparatus configured to supply pressure/flow to the underwater facility (e.g., for sealing tests or for operating valves).

Figure 5:
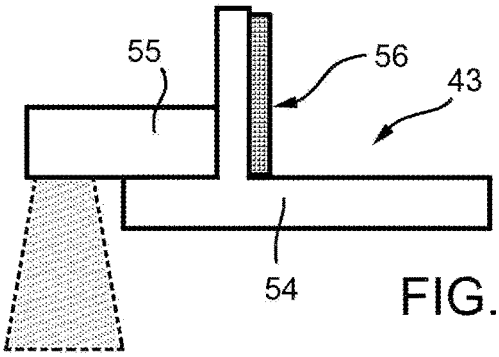

Referring to FIG. 5, the inspection module 43 comprises a support structure 54, one or more probes 55 mounted on the support structure 54, and an interface 56 that defines a face of the support structure 54 and is configured for being connected to interface 39 of the underwater vehicle 27. The inspection module 43 has the task of performing inspection operations on the facility 1 (FIG. 1).

Figure 6:
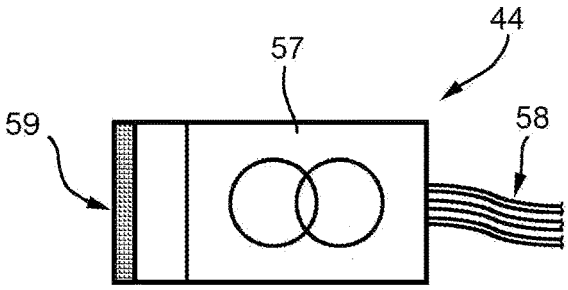
FIGS. 6 to 8 are side elevation views, with parts removed for clarity, of respective power and communication modules in accordance with the present disclosure and parts of the maintenance and inspection system in FIG. 1.

Referring to FIG. 6, the power and communication module 44 comprises a power supply block 57, a power and data transmission cable 58 connected to the power supply block 57, and an interface 59 that defines a face of the power supply block 57. The power and communication module 44 enables infinite operating autonomy, relatively wide range, and real-time data transmission, but has the drawback of requiring a cable 58 of relatively large dimensions that, in some operations, can become a hindrance and impair the maneuverability of the underwater vehicle 27.

Figure 7:
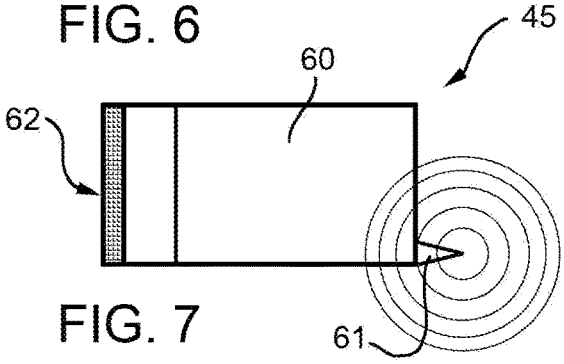

Referring to FIG. 7, the power and communication module 45 comprises a battery block 60, a transceiver 61 for data transmission connected to the battery block 60, and an interface 62 that defines a face of the battery block 60. The power and communication module 45 enables relatively limited operating autonomy and a relatively limited real-time data transmission capability, but the absence of a cable ensures relatively excellent maneuverability for the underwater vehicle 27.

Figure 8:
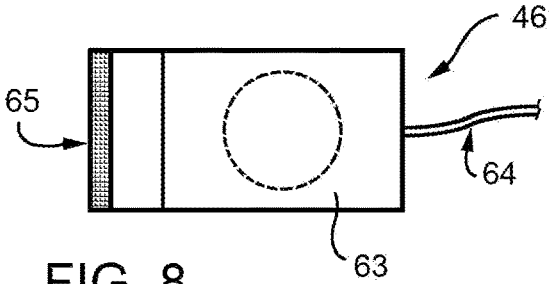

Referring to FIG. 8, the power and communication module 46 comprises a battery block 63, a data cable 64 for data transmission only and connected to the battery block 63, and an interface 65 that defines a face of the battery block 63. The power and communication module 46 enables limited operating autonomy, relatively wide range, and a real-time data transmission capability. A small-sized cable for only data transmission does not excessively hinder and defines an intermediate maneuverability condition for the underwater vehicle 27 with respect to those described with reference to FIGS. 6 and 7.

Figure 9:
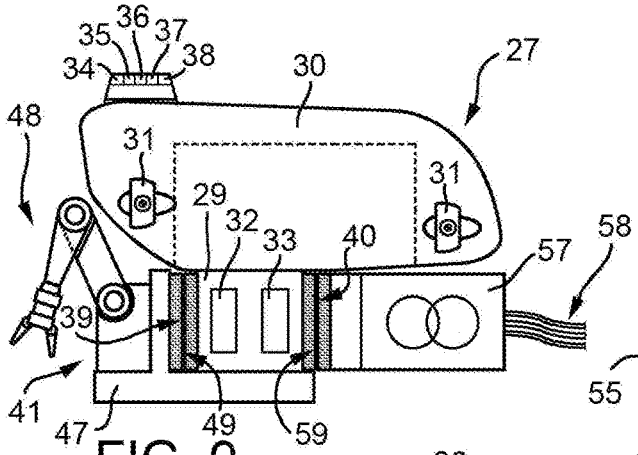
FIGS. 9 to 11 are side elevation views of the underwater vehicle in FIG. 2 in respective operational configurations.
Figure 10:
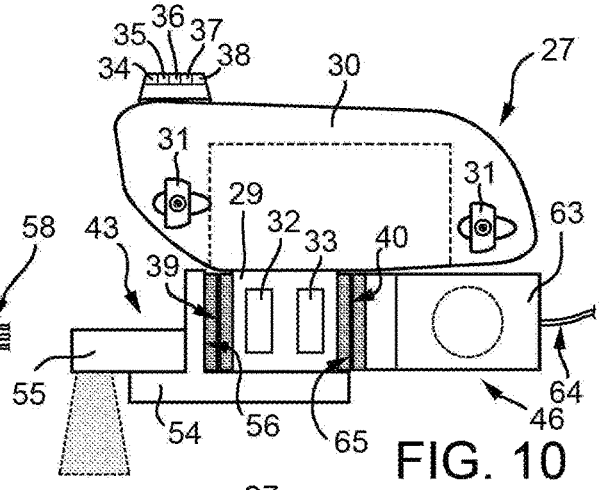
Figure 11:
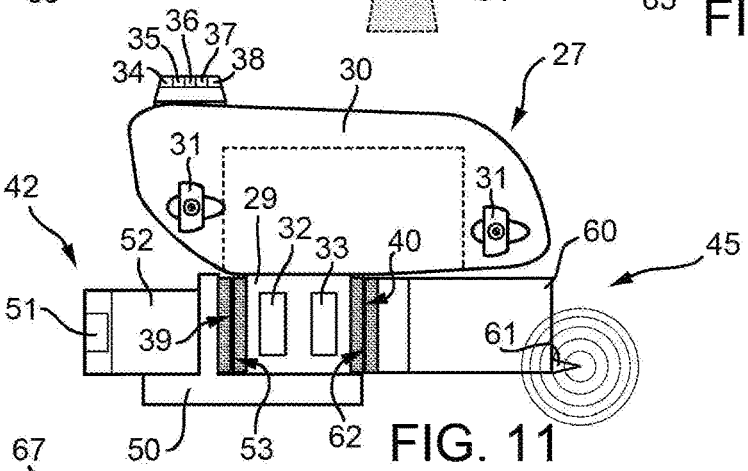

The underwater vehicle 27 can assume various configurations, some of which are shown in FIGS. 9 to 11, based on the possible combinations of operational modules 41, 42 and 43 in FIGS. 3 to 6 and power and communication modules 44, 45 and 46 in FIGS. 6 to 8. In particular, the couplings between the underwater vehicle 27 and the operational modules 41, 42 and 43, and power and communication modules 44, 45 and 46 envisage structural couplings of a mechanical type and functional couplings of an electrical type. In particular, functional electrical couplings are inductive electrical couplings.

Referring to FIGS. 9 to 11, the operational modules 41, 42 and 43, in use, are powered by the power and communication module 44, 45 or 46 coupled to the underwater vehicle 27, but are set up for being independently powered.

Figure 12:
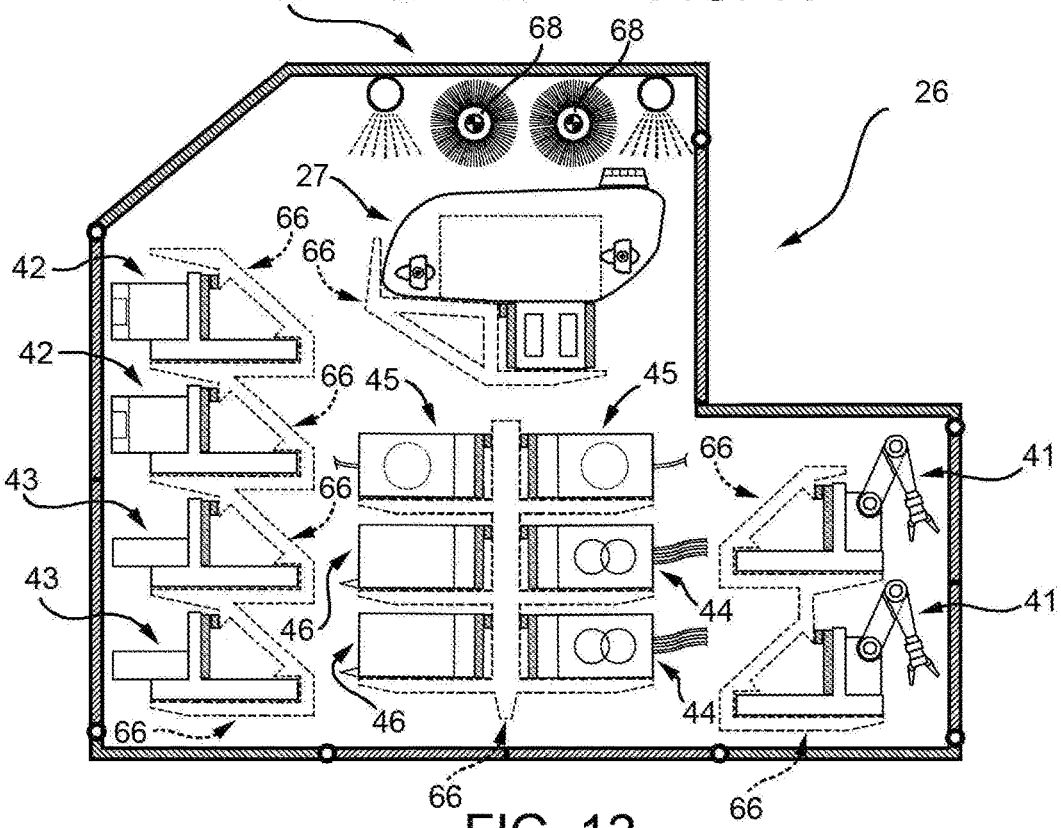
FIG. 12 is a side elevation view, with parts removed for clarity and in section, of a detail of the system in FIG. 1.

Referring to FIG. 12, the base station 26 is configured to define the shelter for the underwater vehicle 27, the operational modules 41, 42 and 43 and the power and communication modules 44, 45 and 46. The base station 26 has parking stations 66, which are also configured for recharging batteries where necessary. In one embodiment, the parking stations 66 are arranged in various points of the underwater facility 1 as shown, for example, by broken lines in FIG. 1.

Furthermore, referring to FIG. 1, the base station 26 handles communications with the underwater vehicle 27 and is connected by the umbilical cable 18 to a surface control unit (not shown in the accompanying figures).

In accordance with one embodiment which is not shown in the accompanying figures, the base station can comprise an umbilical cable for the supply of power and data transmission with the surface or with other underwater systems.

Referring to FIG. 12, the base station 26 is able to communicate with the underwater vehicle 27 both in cable mode, thanks to the parking station 66, and in wireless mode. Wireless communications are of the hybrid type and comprise acoustic, optical and electromagnetic types of communication. Acoustic communications can be disturbed by the morphology of the bed of the body of water and the structure of the underwater facility, optical communications can be compromised by relatively poor visibility in the body of water, and electromagnetic communications in a body of water are only effective over a relatively short range. In consequence, the base station 26 and the underwater vehicle 27 communicate wirelessly with a hybrid system that provides for simultaneously exchanging data with optical, acoustic and electromagnetic communications.

The communication stations 28 in FIG. 1 are configured to transmit and receive data in the same manner as the base station 26 and are thus repeaters of the base station 26.

Referring to FIG. 12, the base station 26 is also configured to perform the washing of the underwater vehicle 27, the operational modules 41, 42 and 43 and the power and communication modules 44, 45 and 46. To this end, the base station 26 comprises a cleaning device 67, which is configured to emit water jets, and comprises brushes 68 configured to remove any fouling that might form following prolonged permanence in the body of water. The cleaning station 67 can also comprise UV radiation generators and/or chemical products and/or ultrasonic generators.

Finally, it should be appreciated that variants regarding the present disclosure can be implemented with respect to the embodiments described with reference to the accompanying drawings without departing from the scope of the claims. For example, in the described example, the maintenance and inspection system is associated with an underwater hydrocarbon production facility, but the claimed vehicle and system may find other applications in an underwater environment. Furthermore, the system can comprise more than one unmanned vehicle and/or more base stations, with the number of unmanned underwater vehicles and base stations depending on the size and complexity of the facility. Accordingly, various changes and modifications to the presently disclosed embodiments will be apparent to those skilled in the art. Such changes and modifications can be made without departing from the spirit and scope of the present subject matter and without diminishing its intended technical scope. It is therefore intended that such changes and modifications be covered by the appended claims.

The invention is claimed as follows:

1. An unmanned underwater vehicle to maintain and inspect a permanent underwater facility, the unmanned underwater vehicle comprising:
- a frame;
- at least one buoy;
- a plurality of thrusters;
- a first interface structurally and functionally couplable to an operational module that is selected, based on a first specific need, from a plurality of interchangeable operational modules featuring different characteristics; and
- a second interface structurally and functionally couplable to a power and communication module that is selected, based on a second specific need, from a plurality of interchangeable power and communication modules featuring different characteristics.

2. The unmanned underwater vehicle of claim 1, wherein the first interface and the second interface are functionally interconnected to mutually transfer power and signals.

3. The unmanned underwater vehicle of claim 1, further comprising at least one power accumulator and a control unit.

4. The unmanned underwater vehicle of claim 1, further comprising a plurality of navigation sensors.

5. The unmanned underwater vehicle of claim 4, wherein the plurality of navigation sensors are selected from the group consisting of: a gyrocompass, a speed sensor, an accelerometer, an acoustic positioning system, and an obstacle avoidance system.

6. A permanent underwater facility maintenance and inspection system comprising:
- a plurality of operational modules featuring different characteristics, the plurality of operational modules comprising at least one manipulator operational module, at least one tool operational module, and at least one inspection operational module;
- a plurality of power and communication modules featuring different characteristics; and
- an unmanned underwater vehicle comprising:
  - a first interface structurally and functionally couplable to one of the plurality of operational modules, wherein the operational module is selected based on a first specific need; and
  - a second interface structurally and functionally couplable to one of the plurality of power and communication modules, wherein the power and communication module is selected based on a second specific need.

7. The permanent underwater facility maintenance and inspection system of claim 6, wherein the manipulator operational module comprises a third interface structurally and functionally couplable to the first interface of the unmanned underwater vehicle.

8. The permanent underwater facility maintenance and inspection system of claim 7, wherein the manipulator operational module comprises a electrically driven manipulator arm.

9. The permanent underwater facility maintenance and inspection system of claim 6, wherein the tool operational module comprises a tool, an actuator and a third interface structurally and functionally couplable to the first interface of the unmanned underwater vehicle.

10. The permanent underwater facility maintenance and inspection system of claim 6, wherein the inspection operational module comprises at least one probe and a third interface structurally and functionally couplable to the first interface of the unmanned underwater vehicle.

11. The permanent underwater facility maintenance and inspection system of claim 6, wherein each operational module is powered by one of the power and communication modules through the unmanned underwater vehicle.

12. A permanent underwater facility maintenance and inspection system comprising:

a plurality of operational modules featuring different characteristics;

a plurality of power and communication modules featuring different characteristics, the plurality of power and communication modules comprising a cable power and cable communication module, a battery power and wireless communication module, and a battery power and cable communication module; and an unmanned underwater vehicle comprising:

a first interface structurally and functionally couplable to one of the plurality of operational modules, wherein the operational module is selected based on a first specific need; and a second interface structurally and functionally couplable to one of the plurality of power and communication modules, wherein the power and communication module is selected based on a second specific need.

13. The permanent underwater facility maintenance and inspection system of claim 12, wherein the cable power and cable communication module comprises a power supply block, a power and data transmission cable, and a third interface structurally and functionally couplable to the second interface of the unmanned underwater vehicle.

14. The permanent underwater facility maintenance and inspection system of claim 12, wherein the battery power and wireless communication module comprises a battery block, a transceiver, and a third interface structurally and functionally couplable to the second interface of the unmanned underwater vehicle.

15. The permanent underwater facility maintenance and inspection system of claim 12, wherein the battery power and cable communication module comprises a battery block, a data cable, and a third interface structurally and functionally couplable to the second interface of the unmanned underwater vehicle.

16. The permanent underwater facility maintenance and inspection system of claim 12, wherein each operational module is powered by one of the power and communication modules through the unmanned underwater vehicle.

17. A permanent underwater facility maintenance and inspection system comprising:

a plurality of operational modules featuring different characteristics;

a plurality of power and communication modules featuring different characteristics; and an unmanned underwater vehicle comprising:

a first interface structurally and functionally couplable to one of the plurality of operational modules, wherein each operational module powerable independently of the unmanned underwater vehicle and the one of the plurality of operational modules is selected based on a first specific need; and a second interface structurally and functionally couplable to one of the plurality of power and communication modules, wherein the power and communication module is selected based on a second specific need.

18. A permanent underwater facility maintenance and inspection system comprising:

a plurality of operational modules featuring different characteristics;

a plurality of power and communication modules featuring different characteristics;

an unmanned underwater vehicle comprising:

a first interface structurally and functionally couplable to one of the plurality of operational modules, wherein the operational module is selected based on a first specific need; and a second interface structurally and functionally couplable to one of the plurality of power and communication modules, wherein the power and communication module is selected based on a second specific need; and a base station to house the unmanned underwater vehicle, the operational modules, and the power and communication modules.

19. The permanent underwater facility maintenance and inspection system of claim 18, further comprising a plurality of parking stations which are configured for recharging a plurality of batteries.

20. The permanent underwater facility maintenance and inspection system of claim 18, wherein said base station comprises cable and wireless communication systems in communication with the unmanned underwater vehicle.

21. The permanent underwater facility maintenance and inspection system of claim 20, further comprising a communication station configured for repeating a wireless signal of the base station.

22. The permanent underwater facility maintenance and inspection system of claim 18, wherein the base station comprises a cleaning device for the unmanned underwater vehicle, the plurality of operational modules, and the plurality of power and communication modules.

23. The permanent underwater facility maintenance and inspection system of claim 22, wherein the cleaning device comprises at least one of brushes configured to remove fouling and ultrasonic generators, and the cleaning device is configured for at least one: spraying pressurized water jets, spraying chemical products, and UV radiation.

24. The permanent underwater facility maintenance and inspection system of claim 18, wherein each operational module is powered by one of the power and communication modules through the unmanned underwater vehicle.

* * * * *